United States Patent [19]

Rowledge

[11] Patent Number: 5,016,797

[45] Date of Patent: May 21, 1991

[54] ARTICLE CARRIER

[76] Inventor: Darrel Rowledge, 2428 Capitol Hill Crescent NW, Calgary, Alberta, Canada, T2M 4C2

[21] Appl. No.: 335,184

[22] Filed: Apr. 7, 1989

[30] Foreign Application Priority Data

Apr. 14, 1988 [CA] Canada ..... 564224

[51] Int. Cl.[5] ..... A45F 5/00

[52] U.S. Cl. ..... 224/257; 224/907; 224/908; 224/909; 224/203

[58] Field of Search ..... 224/907, 908, 909, 271, 224/269, 268, 261, 257–259, 241, 235, 231, 228, 224, 214–216, 211, 209, 208, 205, 204, 202, 197, 199; 354/82, 83

[56] References Cited

U.S. PATENT DOCUMENTS

| | | | |
|---|---|---|---|
| 2,643,803 | 6/1953 | Bates | 224/909 X |
| 3,152,738 | 10/1964 | Worsfold, Jr. | 224/259 |
| 3,507,424 | 4/1970 | Burkins | 224/908 X |
| 3,526,347 | 9/1970 | Kuban | 224/909 X |
| 3,884,403 | 5/1975 | Brewer | 224/908 X |
| 4,033,488 | 7/1977 | Brewer | 224/261 X |
| 4,168,022 | 9/1979 | Brewer | 224/257 |
| 4,232,808 | 11/1980 | Gray | 224/205 |
| 4,320,863 | 3/1982 | Lyer et al. | 224/259 |
| 4,461,411 | 7/1984 | Harrow | 224/208 |
| 4,865,191 | 9/1989 | Easter | 224/909 X |
| 4,923,060 | 5/1990 | Breslau | 224/908 X |
| 4,924,557 | 5/1990 | Heckerman et al. | 224/909 X |

FOREIGN PATENT DOCUMENTS

| | | | |
|---|---|---|---|
| 586030 | 3/1977 | Switzerland | 224/908 |

*Primary Examiner*—Ernest G. Cusick

*Attorney, Agent, or Firm*—Hughes & Multer

[57] ABSTRACT

Small articles such as cameras and binoculars are conventionally carried on either a single strap around the neck of the user, or on a relatively complicated harness arrangement. A simple, comfortable, silent alternative includes a pair of identical shoulder straps which extend from approximately the center of the chest of a user over the shoulders, cross in the back and pass under the arms of the user to the chest area, a connector for adjustably interconnecting the shoulder straps in the back area, a chest strap connected to the spaced apart front bottom ends of the shoulder straps, buckles for releasably connecting the ends of the chest strap to the other, free front ends of the shoulder straps, and swivel hooks slidable on the shoulder straps for releasably retaining the small article suspended from the chest area of the shoulder straps, so that the article can be slid smoothly and silently from the carrying to the use position without disconnecting the article from the carrier.

16 Claims, 4 Drawing Sheets

ARTICLE CARRIER

BACKGROUND OF THE INVENTION

1. Field of the Invention

This invention relates to an article carrier, and in particular to a carrier for small articles such as cameras, binoculars and radios.

2. Background Art

In general, article carriers of the type described herein should be comfortable to the user, should provide secure support for the article, and permit instant non-resistant and silent accessibility to the article. The usual practice of simply hanging cameras or binoculars from the neck on a single strap has long been recognized as unsatisfactory. The displacement of even moderate weight in this fashion can leave the use uncomfortable even during short durations of use. The article can easily swing against other objects and be damaged. Finally, in the absence of a cover, the article is exposed to the elements. While users often seek to secure and protect the article by arranging it inside the clothing, such practice severely impairs accessibility. Weight displacement about the neck remains problematic and troublesome vapour condensation problems occur when cold articles are positioned against a warm body.

A variety of harnesses have been proposed for attachment around the body of the user. In fact, the better carriers for cameras and binoculars include some form of harness system for mounting on the upper body of the user, and brackets or clips for attaching the article to the strap system, and consequently to the body of the user. Preferably, the article carrier offers some protection to the article being carried thereby.

Examples of article carriers of the above described type are found in Canadian Patent No. 1,162,169, which issued to D. M. Lyer et al on Feb. 14, 1984, and U.S. Pat. Nos. 2,643,803, which issued to J. R. Bates on Jun. 30, 1953; 3,152,738, which issued to J. E. Worsfold, Jr. on Oct. 13, 1964 and 3,884,403, which issued to R. A. Brewer on May 20, 1975. The devices disclosed by these patents meet some of the requirements but individually do not meet all of the requirements.

SUMMARY OF THE INVENTION

An object of the present invention is to overcome the dificiences of presently available carriers for small articles by providing a relatively simple small article carrier which is easy to use, and which in at least one embodiment provides protection for the article being carried.

Another object of the invention is to provide a small article carrier which permits comfortable, silent movement of a heavy article from a carrying to a use position, while restricting unwanted swinging in the carrying position.

Yet another object of the invention is to provide a carrier which does not require the release or refastening of clips look and loop (velcro) fastners or the like when moving an article between the carrying and use positions.

Accordingly, the present invention relates to a small article carrier comprising a pair of identical shoulder strap means for extending from approximately the centre of the chest of a user over the shoulders, crossing in the back and under the arms of the user; chest strap means connected to the front, bottom ends of the shoulder strap means, said chest strap means maintaining the front bottom ends of the shoulder strap means in spaced apart relationship to each other; connector means for slidably interconnecting said shoulder strap means in overlapping relationship in the back area of the user; buckle means for connecting the ends of said chest strap means to the other, front free ends of said shoulder strap means; swivel hook means slidable on said shoulder strap means for releasably retaining the small article suspended from the chest area of said pair of shoulder straps means, whereby the article can be slid vertically and rotated around a horizontal axis.

BRIEF DESCRIPTION OF THE DRAWING

The invention will be described in greater detail with reference to the accompanying drawings, which illustrate preferred embodiments of the invention, and wherein.

DESCRIPTION OF THE PREFERRED EMBODIMENTS

Figure 1:
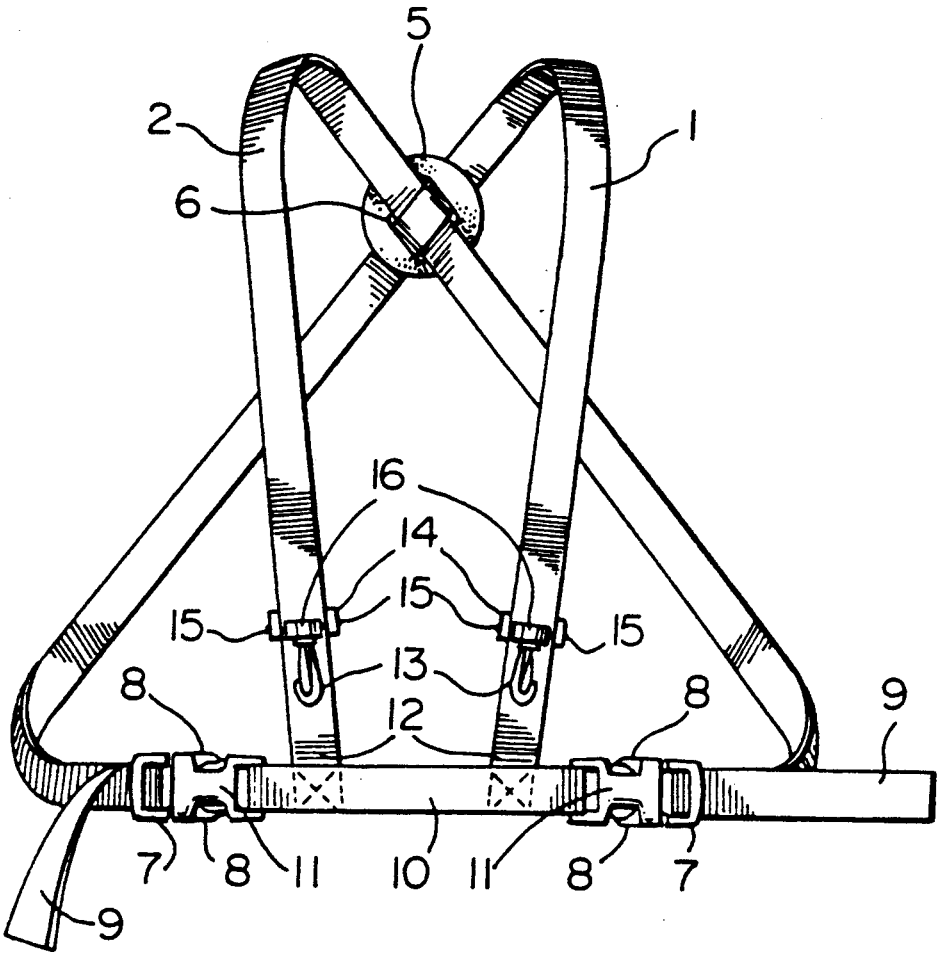
FIG. 1 is a front elevational view of an article carrier in accordance with the present invention.
Figure 4:
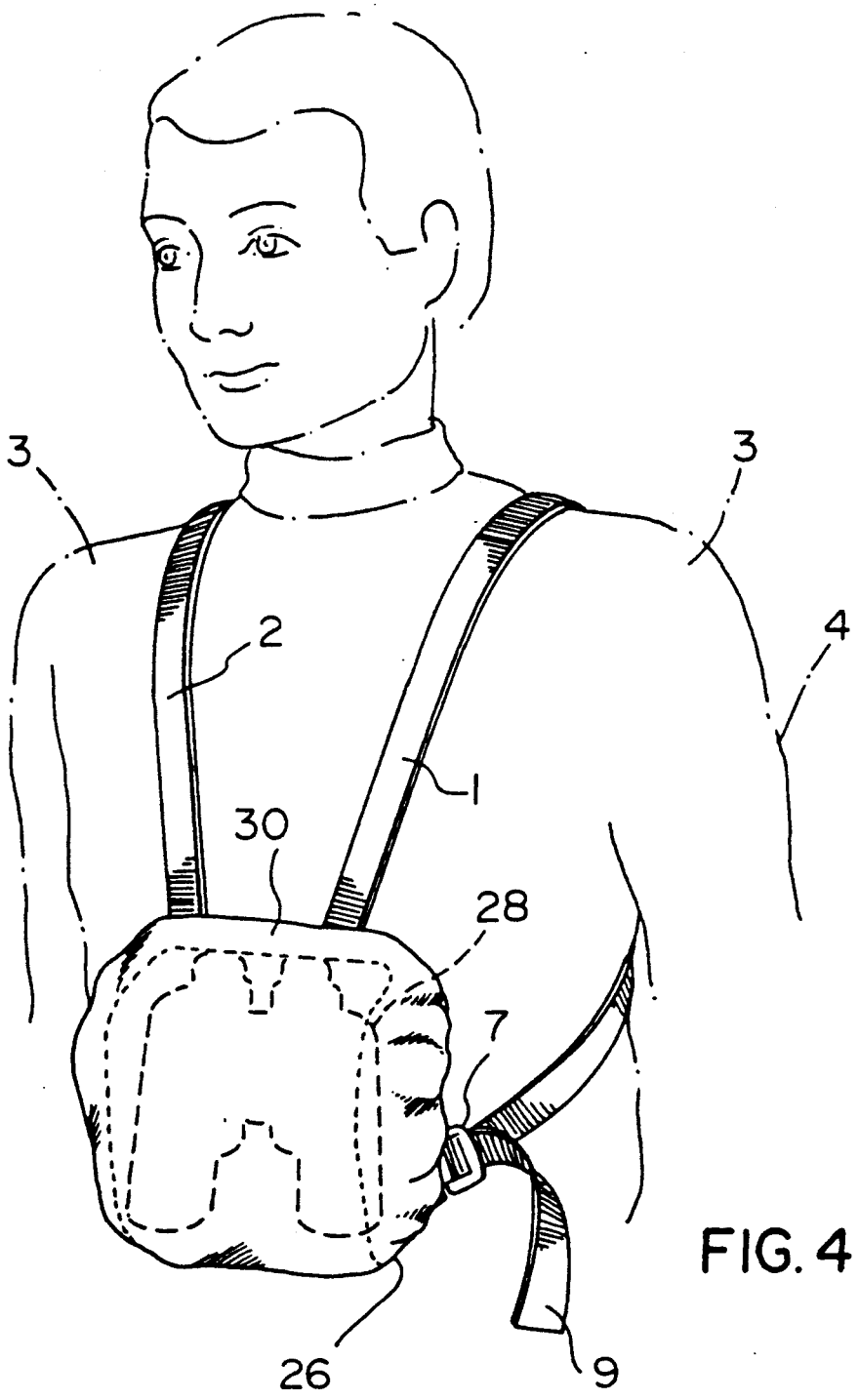
Figure 5:
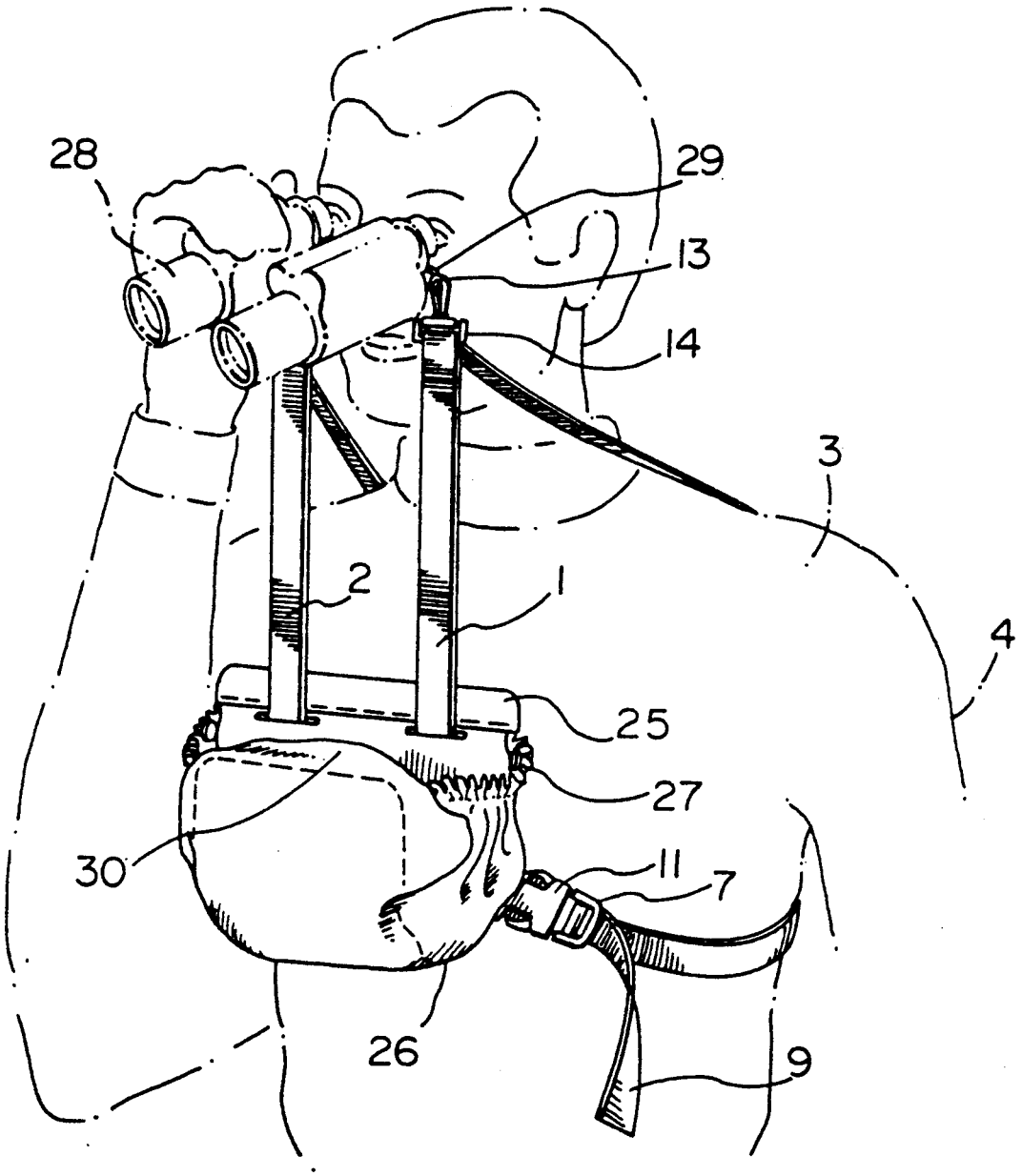

With reference to FIG. 1, the basic embodiment of the invention includes a pair of identical shoulder straps 1 and 2, which are designed to fit over the shoulders 3 of a user 4 (FIGS. 4 and 5).

A connector defined by a disc 5 with a pair of parallel, spaced apart slots 6 is used to interconnect the straps 1 and 2 in overlapping relationship in the back area of the user 4. One of the straps 1 and 2 overlaps one side of the disc 5 and the other strap overlaps the other side of the disc, the strap on the side of the disc extending through the slots 6 and over-lapping the strap on the other side of the disc. Thus, the straps 1 and 2 are held firmly in overlapping relationship, but can be slid longitudinally to adjust the position of the disc 5.

The male portion 7 of a conventional buckle of the type including a pair of flexible fingers 8 is provided on each free end 9 of each strap 1 and 2 for connecting the latter to a chest strap 10. For such purpose, the female portions 11 of the buckles are attached to the ends of the chest strap 10. While the strap 10 has a fixed length, the buckle portions 7 are slidable on the free ends 9 of the straps 1 and 2 for changing the effective lengths of such straps, i.e. permitting adjustment to suit the user's chest dimensions. The other ends 12 of the shoulder straps 1 and 2 are sewn to the cross straps 10 near the ends thereof.

A swivel hook 13 is slidably mounted on the front of each of the straps 1 and 2. The hook 13 includes a generally U-shaped body 14 extending around the strap 1 or 2, so that the hook can slide on the strap, and for pivotally supporting the hook 13 for rotation around a horizontal axis. Pins 15 extend through the arms of the body 14 into the head 16 of the hook. The hook 13 is rotatable in the head 16, so that the hook is rotatable around its own longitudinal axis for facilitating attachment to an article to be carried.

Figure 2:
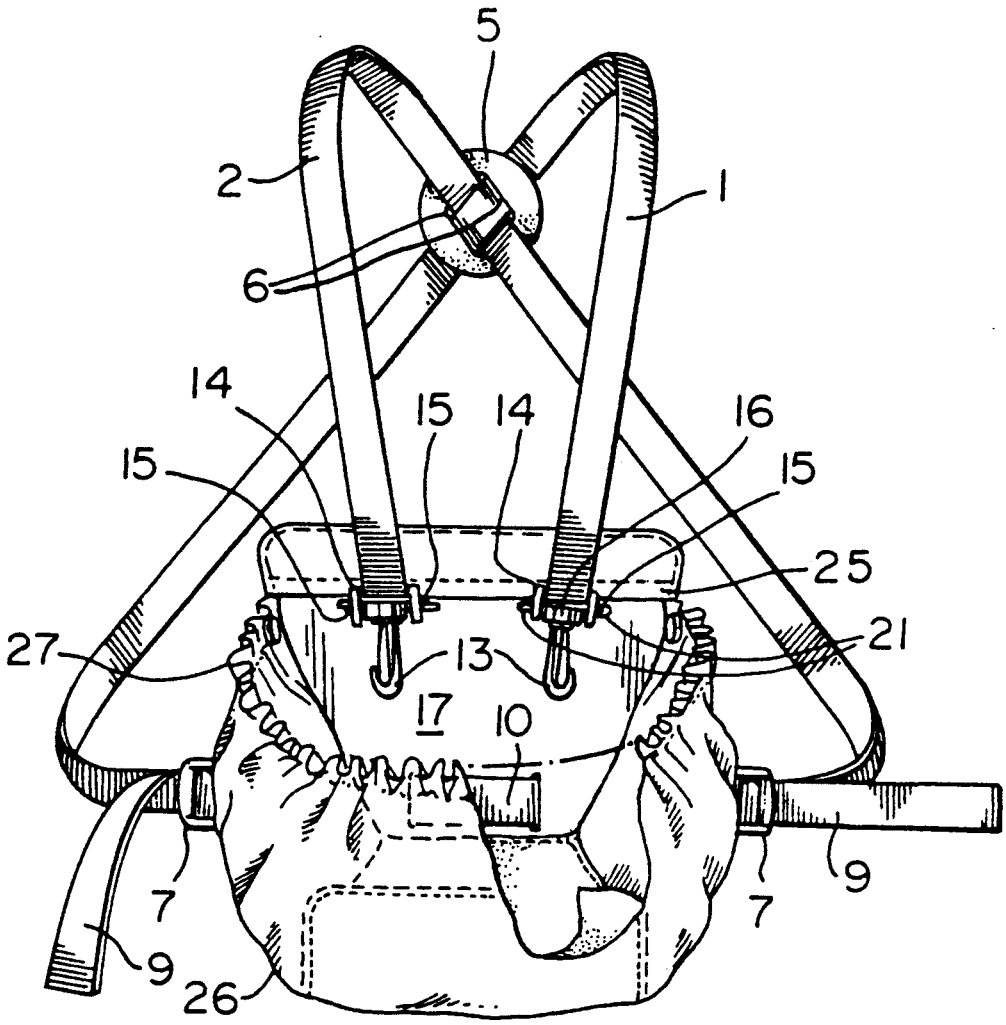
FIG. 2 is a front elevational view of a second embodiment of the article carrier of the present invention.
Figure 3:
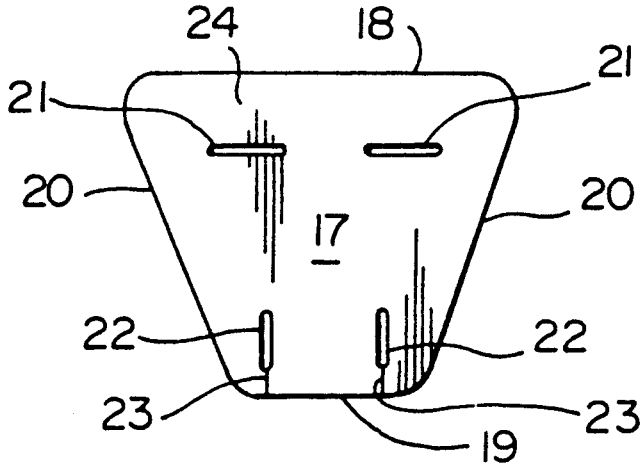
FIG. 3 is a plan view of a support plate used in the carrier of FIG. 2, and FIGS. 4 and 5 are schematic perspective views of the carrier of FIG. 2 in use.

A second embodiment of the invention (FIGS. 2 to 5) includes the same basic elements as the carrier illustrated in FIG. 1, and consequently wherever possible the same reference numerals have been used in all FIGS. The carrier of FIGS. 2 to 5 includes a trapezoidal plate 17, which, as best seen in FIG. 3, has parallel top and bottom edges 18 and 19, respectively, and downwardly and inwardly inclined side edges 20. Horizontal slots 21 near the top edge 18 of the plate 17 are designed to slidably receive the straps 1 and 2, and vertical slots 22 near the bottom edge 19 receive the cross strap 10 (FIG. 2). Slits 23 extend from the bottom edge 19 of the plate 17 to the slots 22, so that the plate can readily be attached and removed from the strap 10. Similar slits (not shown) could be provided at the outer ends of the slots 21, so that the plate could be removed from the straps I and 2.

In use, the top end 24 of the plate 17 is tucked into a bottom opening pocket 25 on the rear side of a small article case or pouch 26, with the shoulder straps 1 and 2 extending through the slots 21, and the cross strap 10 extending through the slots 22. The pouch 26 has an elasticized, top edge 27 (FIG. 2), and is designed to snugly hold a small article, in this case binoculars 28. The clips 13 are attached to the loops 29 (FIG. 5) conventionally provided on binoculars. An overlapped portion 30 is provided on the front or outer side of the pouch 26 for wrapping around the top elasticated edge of the pocket 25 and the top edge of plate 17 contained with the pocket 25, when the pouch is to be closed to protect the contents of the pouch.

It will be noted that when the binoculars 28 are removed from the pouch 26, they can readily be moved upwardly by sliding the hooks 13 along the straps 1 and 2. The movement between the carrying position (FIG. 4) and the use position (FIG. 5) is smooth and silent, altering the shape but not the dimensions of the carrier. Thus, the binoculars (or other small article) are securely connected to the carrier at all times, no disconnecting or re-connecting of the binoculars being required.

The embodiments of the invention in which an exclusive property or privilege is claimed are defined as follows:

1. A small article carrier comprising a pair of shoulder strap means for extending from a front chest portion of a user over shoulders of the user, crossing in the back and under arms of the user; chest strap means connected to front, bottom portions of the pair of shoulder strap means, said chest strap means maintaining the front bottom ends of the should strap means in spaced apart relationship to each other; connector means for interconnecting said shoulder strap means in overlapping relationship in a back area of the user; buckle means for connecting ends of said chest strap means to other, front free ends of said pair of shoulder strap means; and hook means pivotally and slidably mounted on said pair of shoulder strap means for releasably retaining a small article suspended form a chest area of said pair of shoulder strap means, whereby the article can be slid vertically and rotated around a horizontal axis.

2. A carrier according to claim 1, wherein said connector means is formed with a pair of parallel, spaced apart slots in said connector means permitting insertion of one of said shoulder strap means on one side of said connector means through the slots for overlapping the other said shoulder strap means on the other side of said connector means, whereby said pair of shoulder strap means arre firmly and slidably interconnected.

3. A carrier according to claim 1, wherein each said hook means includes a hook, and pivot means slidably and pivotally connecting said hook to one said shoulder strap means for sliding movement on said pair of shoulder strap means, and rotation around a horizontal axis.

4. A carrier according to claim 1, including plate means to connect to said pair of shoulder strap means and chest strap means; and cover means carried by said plate means for carrying and protecting the small article.

5. A carrier according to claim 4, wherein said plate means comprises a plate, first spaced apart, aligned slot means in said plate for receiving said pair of shoulder strap means; and second spaced apart, parallel slot means in said plate for receiving said chest strap means.

6. A carrier according to claim 4, wherein said cover means includes bottom opening pocket means for mounting on a top portion of said plate means, whereby said cover means is supported in a fixed position on the carrier, while the article can be removed from the cover means and slid upwardly out of said cover means.

7. A small article carrier adapted to be worn by a person, said carrier comprising:

a. a shoulder strap means arranged to extend from a shoulder location of the person downwardly over the persons's chest;

b. a front body strap means extending generally horizontally across a front body portion of the person and connecting to lower front ends of said shoulder strap means;

c. a hook means to connect to said article, said hook means having a slide connection to said shoulder strap means, the slide connection being arranged so that the hook means has a lower position on said shoulder strap means where an article is carried at a lower location in front of the person's body, and slidable upwardly along said shoulder strap means to an upper position where said article, while still connected to said hook means can be positioned adjacent to a person's head for use.

8. The carrier as recited in claim 7, wherein said carrier includes back strap means which extends from upper portions of said shoulder strap means downwardly and laterally across a back portions of the person to connect to opposite portions of said front body strap means.

9. The carrier as recited in claim 8, wherein said back strap means are formed as extensions of said shoulder strap means, with said back strap means comprising two back straps which extend from the back portion of the person's body underneath the person's arms.

10. The carrier as recited in claim 9, wherein each of said back straps connects to said front body strap means with adjustable strap connections at opposite side locations of the front body strap means, whereby length of the back straps can be adjusted relative to said front body strap means.

11. The carrier as recited in claim 10, wherein said shoulder strap means comprises two shoulder straps which extend upwardly over the chest of the person and over the person's shoulders with the two back straps extending from the shoulder straps downwardly so as to cross one another.

12. The carrier as recited in claim 9, wherein said shoulder strap means comprises two shoulder straps which extend upwardly over the chest of the person and over the person's shoulders with the two back straps extending from the shoulder straps downwardly so as to cross one another.

13. The carrier as recited in claim 7, wherein said shoulder strap means comprises two shoulder straps extending from the shoulder location of the person downwardly over the person's chest, with lower portions of the shoulder straps connecting to the front body strap means at laterally spaced locations.

14. The carrier as recited in claim 13, said carrier further comprising plate means having first spaced apart, aligned slots in said plate means for receiving said shoulder straps, and second spaced apart slots for receiving the front body strap means.

15. The carrier as recited in claim 14, wherein there is cover means which has a bottom opened pocket for mounting on a top portion of the plate means, whereby said cover means is supported in a fixed position on the carrier, while the article can be removed upwardly out of said cover means.

16. The carrier as recited in claim 7, wherein there is cover means which is supported in a fixed position on the carrier, adjacent to the lower position of the hook means in a manner that the article can be removed from the cover means and slide upwardly out of said cover means.

* * * * *